US008374374B2

(12) United States Patent
Zhou

(10) Patent No.: US 8,374,374 B2
(45) Date of Patent: Feb. 12, 2013

(54) HEADSET WITH A PIVOTING MICROPHONE ARM

(75) Inventor: Wales Zhou, SIP Suzhou (CN)

(73) Assignee: Plantronics, Inc., Santa Cruz, CA (US)

( * ) Notice: Subject to any disclaimer, the term of this patent is extended or adjusted under 35 U.S.C. 154(b) by 1095 days.

(21) Appl. No.: 11/970,447

(22) Filed: Jan. 7, 2008

(65) Prior Publication Data

US 2009/0175480 A1 Jul. 9, 2009

(51) Int. Cl.
*H04R 25/00* (2006.01)

(52) U.S. Cl. ..... 381/375; 381/330; 381/381; 381/383; 455/575.2; 379/430

(58) Field of Classification Search ..... 381/330, 381/374–376, 380–381, 383; 455/575.2; 379/430
See application file for complete search history.

(56) References Cited

U.S. PATENT DOCUMENTS

| | | | | |
|---|---|---|---|---|
| 5,721,775 | A | 2/1998 | Leifer | |
| 5,978,689 | A | 11/1999 | Tuoriniemi | |
| 7,120,267 | B2 | 10/2006 | Ito | |
| 7,130,419 | B2 * | 10/2006 | Bodley et al. | 379/430 |
| 7,190,797 | B1 | 3/2007 | Johnston et al. | |
| 7,949,127 | B2 * | 5/2011 | Pedersen et al. | 379/430 |
| 8,090,135 | B2 * | 1/2012 | Lin | 381/381 |
| 2005/0107131 | A1 * | 5/2005 | Abramov | 455/569.1 |

FOREIGN PATENT DOCUMENTS

WO 0186923 A1 11/2001

* cited by examiner

*Primary Examiner* — Ramon Barrera
(74) *Attorney, Agent, or Firm* — Andre Tacdiran

(57) ABSTRACT

In one embodiment, a headset includes a body housing a pivot coupling, a speaker capsule operably coupled to the body, and an arm operably coupled to the body. The arm is capable of pivoting open and close about the pivot coupling for accessing a microphone at a free end of the arm. A method for accessing a headset microphone is also provided. Advantageously, the apparatus and method of the present disclosure provide for improved headset use and speech clarity.

18 Claims, 9 Drawing Sheets

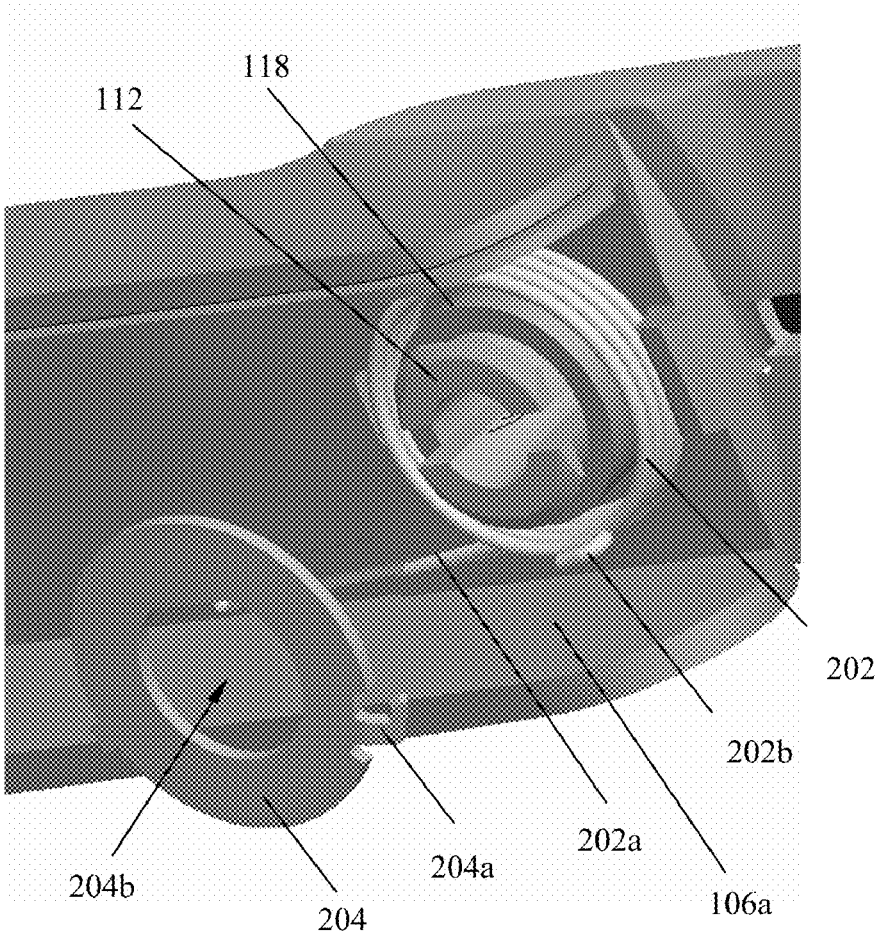
FIG. 4C1

HEADSET WITH A PIVOTING MICROPHONE ARM

BACKGROUND

1. Field of the Invention

This invention generally relates to headsets containing earphones and, more particularly, to an "in-the-ear" type of headset apparatus with a pivoting microphone arm.

2. Description of Related Art

Telephone headsets are gaining popularity in and out of the workplace as more and more users either have jobs requiring that they spend a substantial amount of time on the telephone or users simply desire to listen or speak on the telephone with their hands free to perform other tasks.

One type of headset, which can incorporate one or two earphones for monaural or stereo listening, is known as an "in-the-ear" type headset, which employs an earphone that fits into the cavum area, or entrance to a user's middle ear.

Hands-free headsets which are placed in the ear include a speaker for listening to audio and a microphone for speaking into. Oftentimes, prior headsets included microphones which were far removed from a user's mouth decreasing voice quality, required manual movement of a microphone boom, and/or were typically burdened with a large form factor. However, comfort, stability, ease of use, and aesthetics are key elements that must be met in order for a headset to be acceptable to the end user.

Therefore, there is a need in the art for a headset apparatus that is comfortable, stable on the ear, and provides simple and improved access to a microphone in a small form factor.

SUMMARY

In accordance with the present invention, apparatus and methods are provided for simply accessing a headset microphone with an automated pivoting microphone arm.

In one aspect of the invention, a headset comprises a body housing a pivot coupling, a speaker capsule operably coupled to the body, and an arm operably coupled to the body. The arm is capable of pivoting open and close about the pivot coupling for accessing a microphone at a free end of the arm.

In another aspect of the present invention, a headset comprises a body housing a pivot coupling including a first spring, a washer, a lock, and a second spring, a speaker capsule operably coupled to the body, and an arm operably coupled to the body via the pivot coupling. The headset further includes a button rod operably coupled to the pivot coupling, the button rod actuating the pivot coupling when depressed to pivot the arm open for accessing a microphone at a free end of the arm.

In yet another aspect of the invention, a method for accessing a headset microphone comprises providing a headset including a body housing a pivot coupling, a speaker capsule operably coupled to the body, an arm operably coupled to the body via the pivot coupling, and a button rod operably coupled to the pivot coupling. The method further includes depressing the button rod to pivot the arm about the pivot coupling, thereby making accessible a microphone at a free end of the arm.

Advantageously, the present invention provides headsets and methods for accessing a headset microphone that are efficient, automated, comfortable, and stable on the ear.

These and other features and advantages of the present invention will be more readily apparent from the detailed description of the embodiments set forth below taken in conjunction with the accompanying drawings.

Figure 1A:
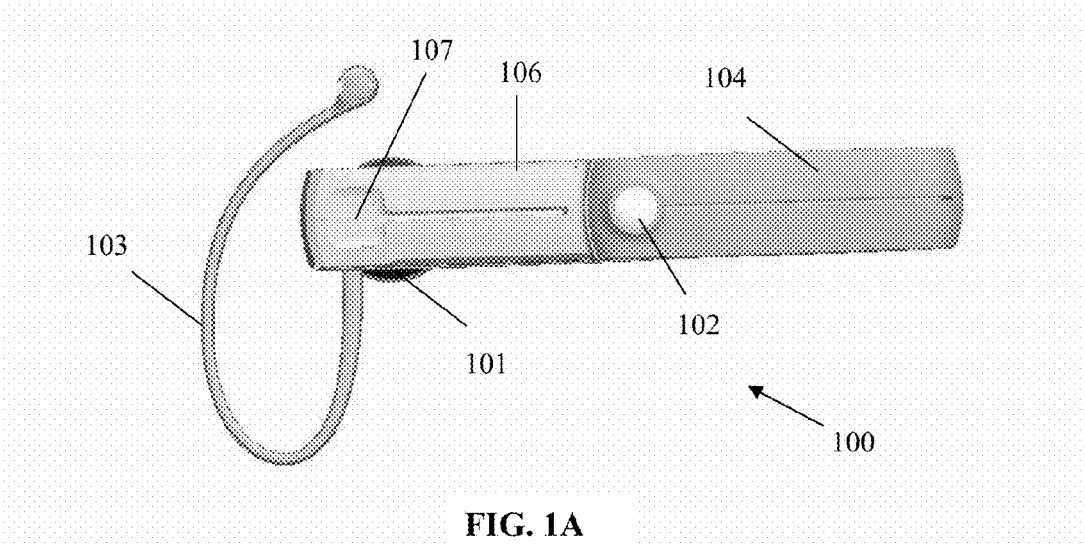
FIGS. 1A-1C illustrate top, side, and bottom views, respectively, of a headset in accordance with an embodiment of the present invention.

Embodiments of the present invention and their advantages are best understood by referring to the detailed description that follows. It should be appreciated that like reference numerals in different figures indicate similar or identical items. It should also be appreciated that the figures may not be necessarily drawn to scale.

DETAILED DESCRIPTION

In accordance with the present invention, a headset including an automatic pivoting microphone arm and a method for accessing a headset microphone are provided.

Figure 1B:
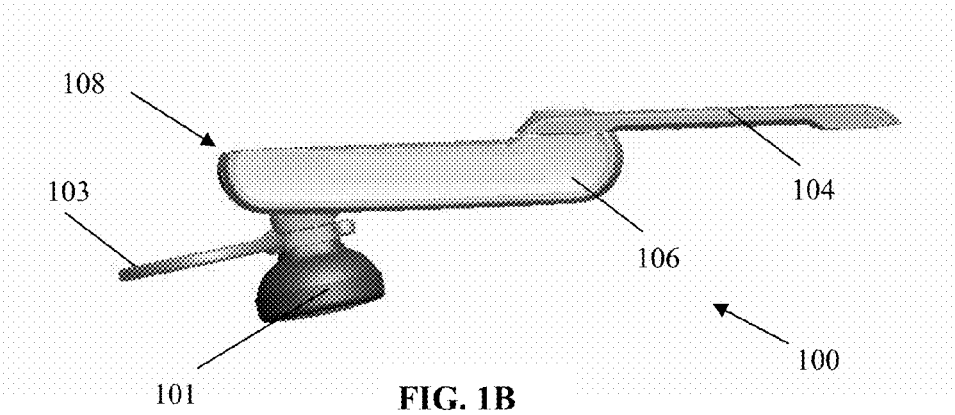
Figure 1C:
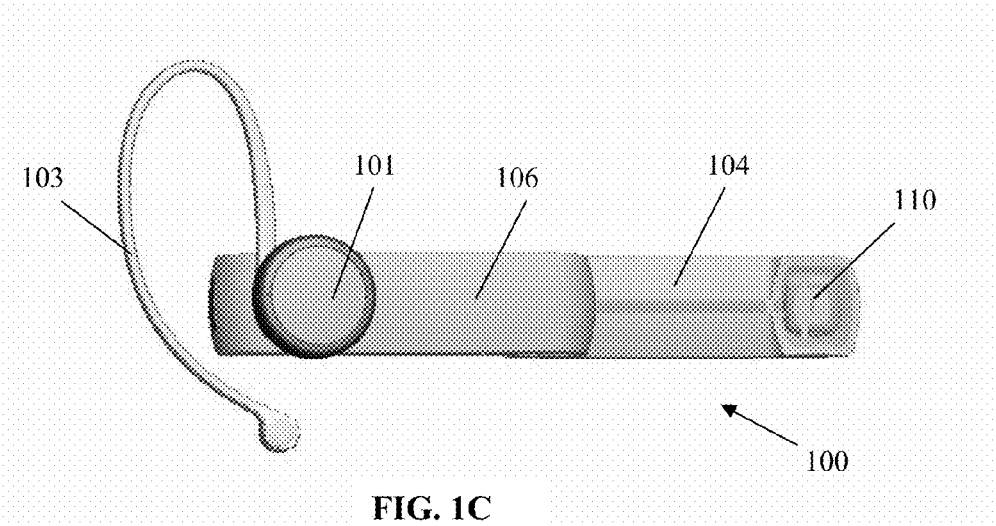

Referring now to FIGS. 1A through 1C, top, side, and bottom views of a headset 100 are illustrated in accordance with an embodiment of the present invention. Headset 100 may be used with an audio source, such as a telephone handset, a cellular phone, a personal computer, a PDA, or a communication network. However, the invention is not limited to receiving a signal from a specific audio source. Headset 100 may be connected to an audio source wirelessly or via a wire. Further, headset 100 may be used for either monaural or stereo listening by applying headset 100 to one or each ear of a user.

In one embodiment, headset 100 includes a button rod 102 that, when depressed, actuates a pivot coupling assembly 200 (see FIG. 3A) to pivot an arm 104 that includes a microphone 110 at a free end. Arm 104 is operably coupled to an end of a body 106 which houses the pivot coupling assembly. A speaker capsule 101 is also operably coupled to body 106, in one example at an opposite end of body 106 to the pivot coupling assembly. Optionally, an earhook 103 adapted to fit at least partially behind the outer ear may be coupled to headset 100 near the interface of speaker capsule 101 and body 106 to provide support for the headset when worn on a user's ear. Various earhooks or supports may be utilized. In a further embodiment, a top surface of body 106 may include a depression 107 (FIGS. 1A and 2B) that receives microphone 110 when headset 100 is in the closed position.

Figure 1D:
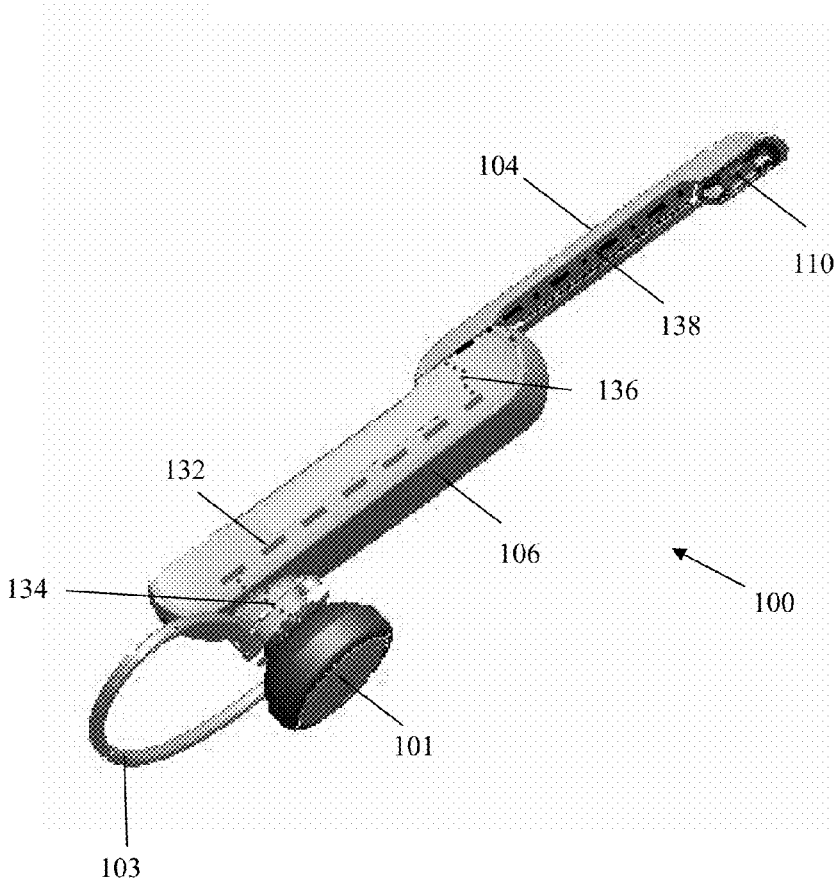
FIG. 1D illustrates a perspective view of the headset of FIGS. 1A-1C showing electrical connections of a speaker and a microphone in accordance with an embodiment of the present invention.

FIG. 1D illustrates a perspective view of the headset 100 showing an outline of a printed circuit board assembly (PCBA) 132 (dashed lines) housed within body 106 and electrical connections of a speaker and a microphone to the PCBA in accordance with an embodiment of the present invention. In one example, PCBA 132 includes a processor, a memory, and a network interface for wireless connectivity to a communications network. In other embodiments, headset 100 may be connected to an audio source via a wire operably coupled on one end to the PCBA and on the other end to the audio source.

In one embodiment, the processor allows for processing data, in one example information about access points (APs), Voice over Internet Protocol (VoIP) service providers, and VoIP service accounts. The processor may be a high performance, highly integrated, and highly flexible system-on-chip (SOC) in one example, including signal processing functionality such as echo cancellation/reduction and gain control in another example. The processor may include a variety of processors (e.g., digital signal processors) with conventional CPUs being applicable.

In one embodiment, the memory may include a variety of memories, and in one example includes SDRM, ROM, flash memory, or a combination thereof. The memory may further include separate memory structures or a single integrated memory structure. In one example, the memory may be used to store passwords, network and telecommunications programs, and/or an operating system (OS). In one embodiment, the memory may include AP/hotspot information, VoIP service provider information, and VoIP account information.

The network interface may allow for communication with audio sources, and in one example includes a transceiver for communicating with a wireless local area network (LAN) radio transceiver (e.g., via wireless fidelity (WiFi), Bluetooth, ultra wideband (UWB) radio, etc.) for access to a network (e.g., a wireless LAN, the Internet, a cellular network, etc.). The network interface may be adapted to derive a network address for the headset using the headset's electronic serial number, which is used to identify the headset on the network. In one embodiment, the electronic serial number may be the headset's Media Access Control (MAC) address; however, the electronic serial number may be any number that is mappable to a network address. The network interface may be further adapted to communicate over a network using the network address that it derives for the headset. In one embodiment, the network interface is able to transmit and receive digital and/or analog signals, and in one example communicates over a network using IP, wherein the network interface uses the headset's MAC address or another globally unique address as its IP address. In particular, the network interface may be operably coupled to a network via the IEEE 802.11 protocol. However, the network interface may communicate using any of various protocols known in the art for wireless connectivity, such as Bluetooth. An example of an applicable network interface is described in pending U.S. patent application Ser. No. 10/091,905 filed Mar. 4, 2002, the full disclosure of which is hereby incorporated by reference for all purposes.

A transducer in speaker capsule 101 is electrically coupled to PCBA 132 via speaker wires 134, and microphone 110 is electrically coupled to PCBA 132 via a flexible printed circuit (FPC) 136 and a wire 138 (FIG. 3C) in one embodiment. In one example, FPC 136 may be used to electrically connect the PCBA in body 106 to the microphone in arm 104 through pivot coupling assembly 200 for flexible connectivity as arm 104 pivots back and forth between a closed and open position. A flat flexible cable may also be used in another example.

In one embodiment, as described above with respect to FIG. 1D, the transducers of speaker capsule 101 and the microphone 110 are electrically coupled to PCBA 132 (FIG. 3C), which is wirelessly or via wire coupled to an audio source, such as a telephone handset, a cellular phone, a personal computer, a PDA, or a communication network. Various protocols, including but not limited to Bluetooth and WiFi, may be used for wireless communication between the PCBA and the audio source.

In another embodiment, wires (not shown) from the PCBA may extend outside of headset body 106 to directly connect to an audio source. Exterior wires can be protected inside a cable, which is made from a non-conductive material in one embodiment. Optionally, a cable boot may be operably connected to headset body 106 where the cable enters headset body 106 and surrounds a portion of the cable adjacent to the outside of headset body 106. The cable boot may be made from a flexible material in one embodiment and protects the area of the cable just outside of headset body 106 from possible causes of disconnection, such as undesired bending and pulling that might cause a malfunction. The invention is not limited to using the aforementioned materials and the headset body, cable boot, and cable may be made of any protective material, such as rubber or polymer compounds.

Furthermore, a connector at the end of the exterior wires, such as a RJ-11 connector or a 2-3.5 mm plug, may operably connect the headset to an audio source, such as a telephone handset, cellular telephone, or a computer.

Headset 100 includes speaker capsule 101 for insertion into a recess of a headset user's ear, such as the cavum area, which leads to the ear canal. Speaker capsule 101 includes a speaker faceplate and encloses a transducer, such as an electro-acoustic speaker. The transducer receives audio signals from an audio signal source and may comprise a known type of electromagnetic, piezoelectric, or electrostatic type of driving element, or a combination thereof, or even some other form of driving element, for generating sound waves from the output face of the transducer and toward the speaker faceplate. In one embodiment, speaker capsule 101 may be sized to be as small as the enclosed transducer will allow to maximize fit into the recess of the user's ear. Accordingly, speaker capsule 101 may seal to the inner features of the user's ear to block out external noise while directing sound from the transducer to the eardrum. In other embodiments, the speaker capsule may be shaped more similar to a loose-fitting earbud. The invention is not limited to a specific speaker capsule or speaker faceplate, and any applicable speaker capsule may be used to direct sound from the transducer to the user's eardrum.

Figure 3A:
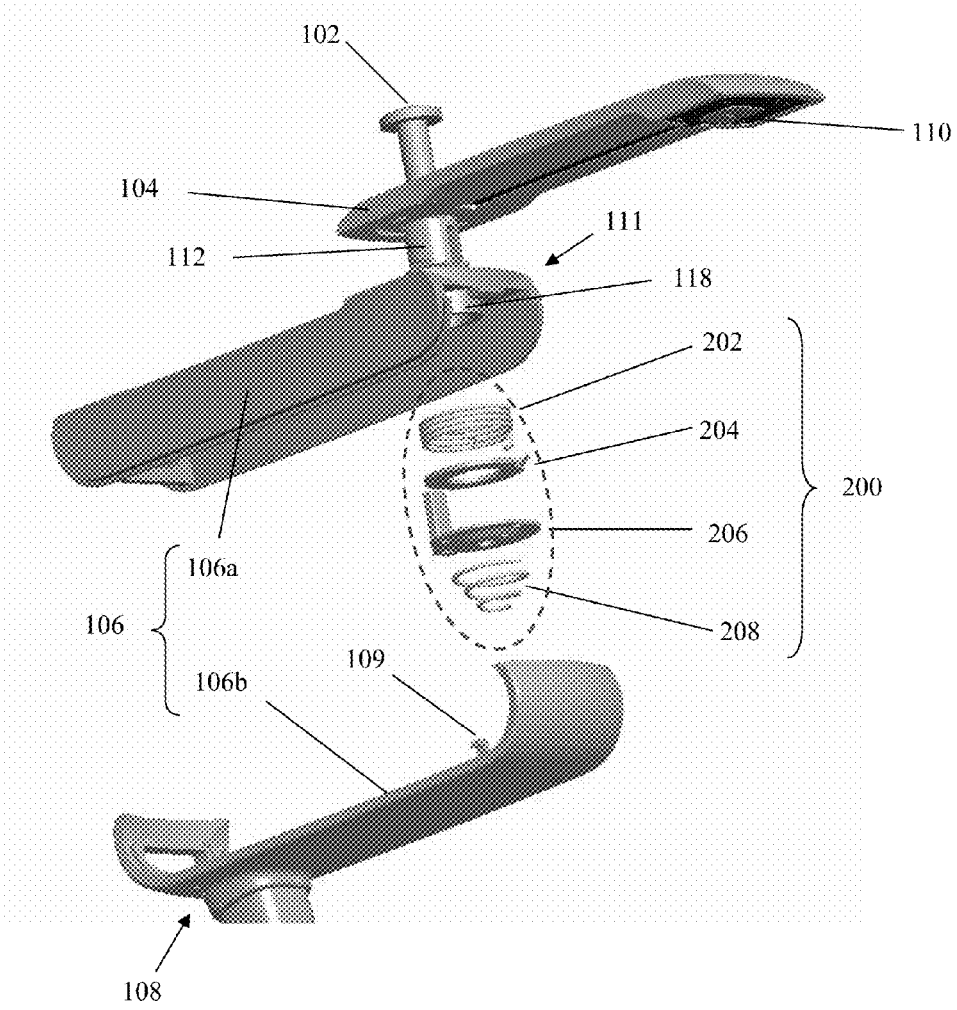
FIG. 3A illustrates an exploded view of the headset of FIGS. 1A-1D in an open position in accordance with an embodiment of the present invention.

In one embodiment, speaker capsule 101 is operably connected to body 106 approximate a first end 108 (FIG. 1B), which in one example may be opposite to the pivot coupling assembly 200 (FIG. 3A). Speaker capsule 101 may be fixedly connected to body 106 or alternatively, movably connected to body 106 by a movable joint, such as a ball-in-socket joint or a hinge mechanism, allowing speaker capsule 101 to have multi-directional movement in relation to body 106. A movable joint which allows for multi-directional movement increases comfort and fit for the headset user when speaker capsule 101 is inserted into the ear and headset 100 is fully mounted. In another embodiment, speaker capsule 101 is coupled to body 106 as a single structure, thereby not allowing for any movement between speaker capsule 101 and body 106.

Microphone 110 enables two-way voice communication by the user and the transducer of microphone 110 may be operably coupled to an audio source wirelessly via various protocols or via wire as described above with respect to PCBA 132. A microphone faceplate may include a mesh opening to allow the user to transmit voice signals as desired.

In another embodiment, headset body 106 may further include a call switch that is operably coupled to the PCBA to allow for quick access and actuation of the answer/end call function.

Figure 2A:
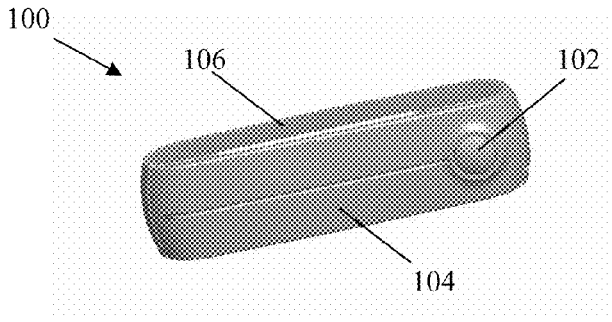
FIGS. 2A-2C illustrate perspective views of the headset of FIGS. 1A-1D in a closed position, an open position, and back to a closed position, respectively, in accordance with an embodiment of the present invention.
Figure 2B:
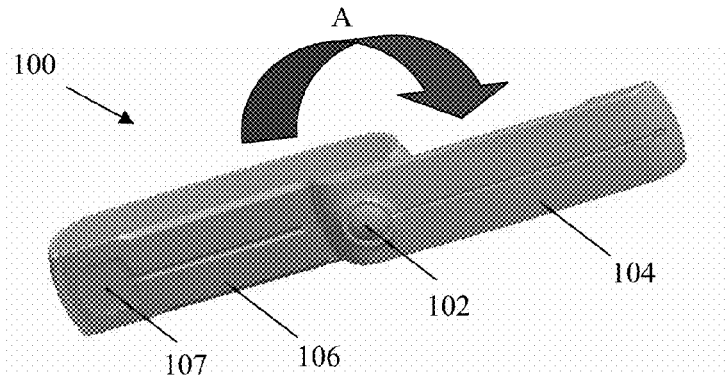
Figure 2C:
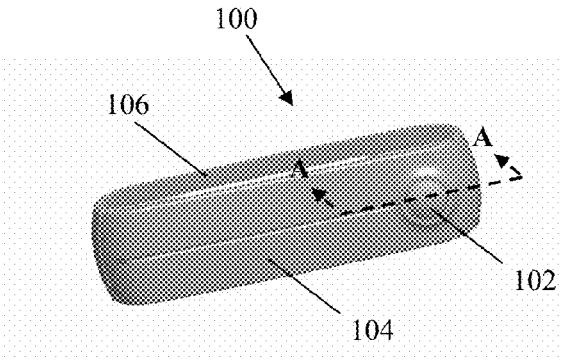

FIGS. 2A, 2B, and 2C illustrate perspective views of the headset 100 of FIGS. 1A-1D in a closed position where arm 104 substantially fully overlaps body 106, an open position after depression of button rod 102 causes arm 104 to pivot approximately 180 degrees about the pivot coupling assembly as shown by arrow A, and back to a closed position after manual repositioning of arm 104 by the user, respectively, in accordance with an embodiment of the present invention.

Figure 3B:
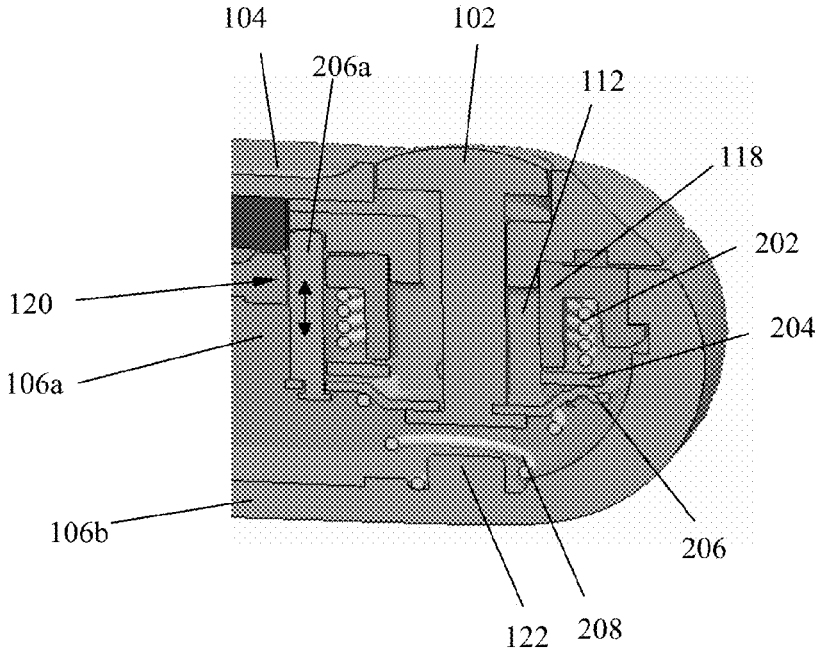
FIGS. 3B and 3C illustrate sectional views of the headset of FIG. 2C in a closed position along a line A-A in accordance with an embodiment of the present invention.
Figure 3C:
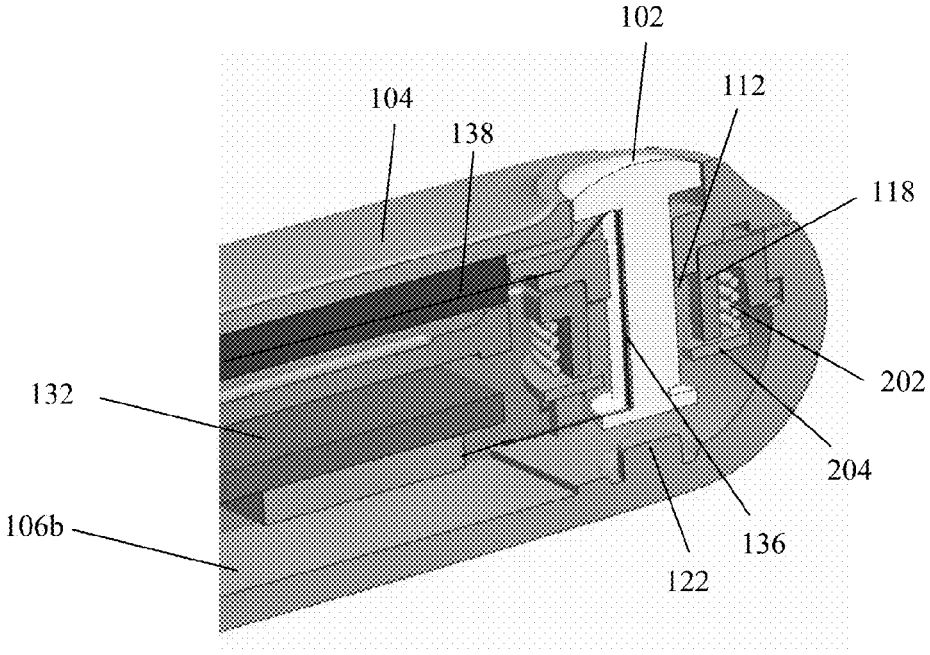

Referring now to FIGS. 3A-3C in conjunction with FIGS. 4A-4H, an exploded view of the headset of FIGS. 1A-1D and 2A-2C in an open position is illustrated in FIG. 3A, and sectional views of the headset of FIG. 2C in a closed position along a line A-A are illustrated in FIGS. 3B and 3C. FIGS. 4A-4H illustrate perspective views for assembling the parts of the headset shown in FIG. 3A in accordance with an embodiment of the present invention.

In one embodiment, headset body 106 is comprised of two parts, an upper body 106*a* and a lower body 106*b*. In one embodiment, headset body 106 is comprised of hard plastic and houses pivot coupling assembly 200. Pivot coupling assembly 200 and pin rod 102 operably couple arm 104 to body 106 and allow for automatic pivoting of arm 104 about the pivot coupling assembly 200 as further described below.

Figure 4A:
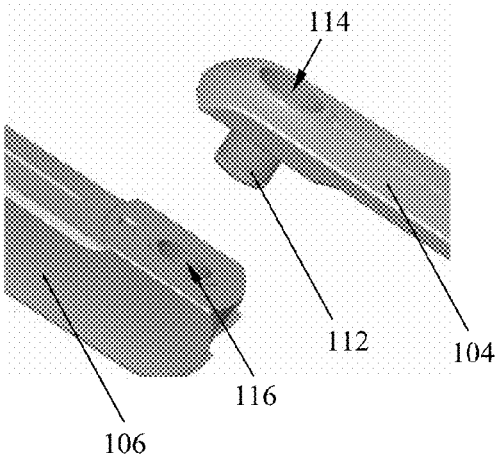
FIGS. 4A through 4H illustrate perspective views for assembling the parts of the headset of FIG. 3A in accordance with an embodiment of the present invention.
Figure 4B:
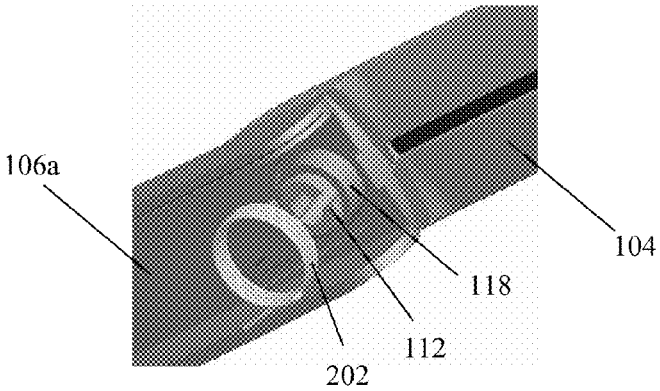
Figure 4C:
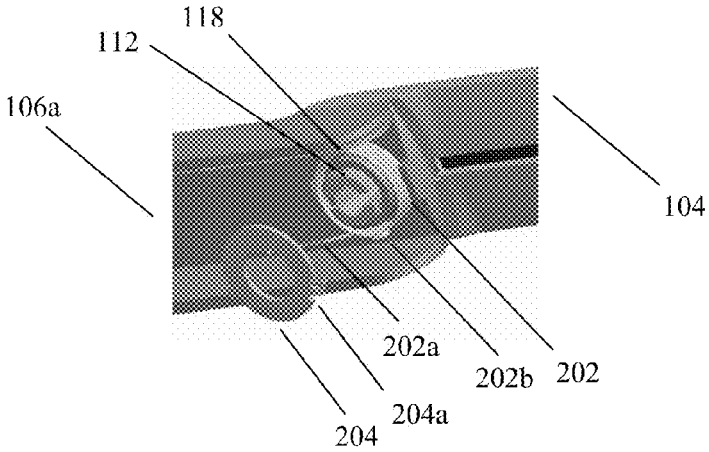
Figure 4D:
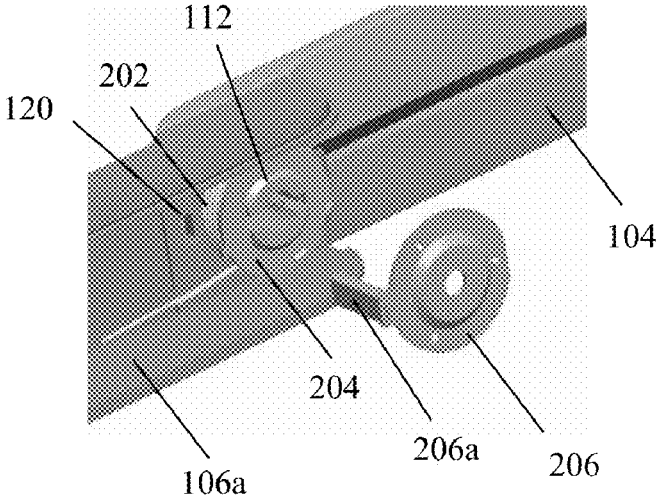
Figure 4E:
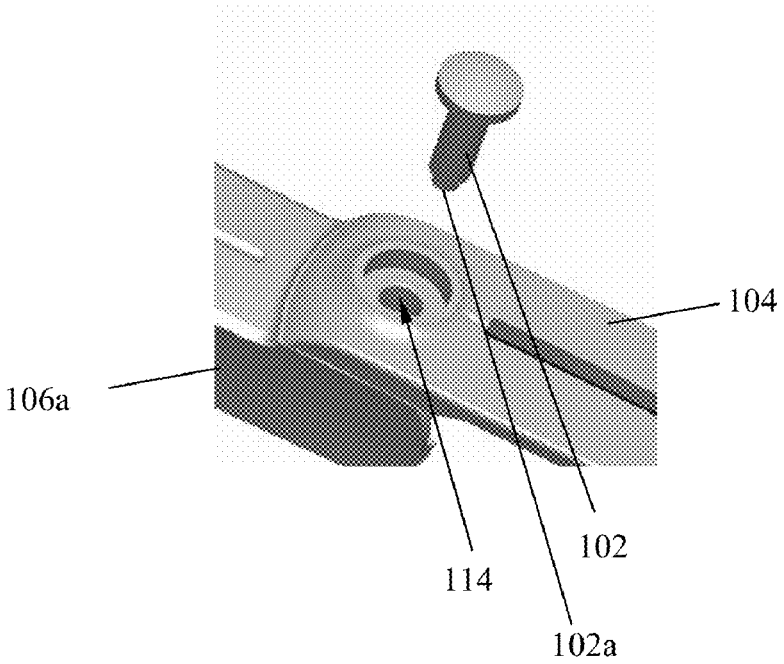
Figure 4F:
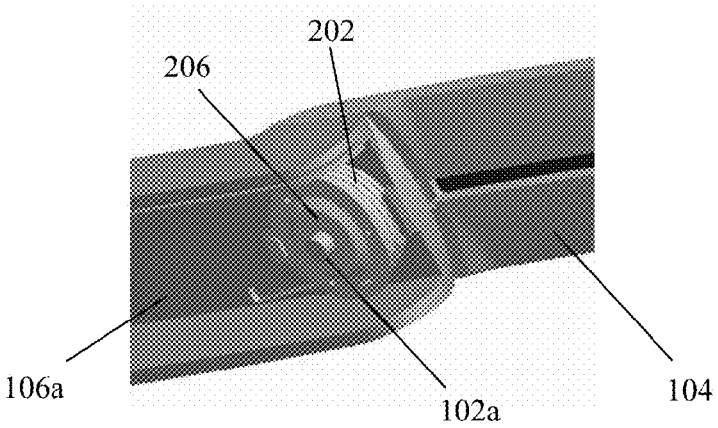
Figure 4G:
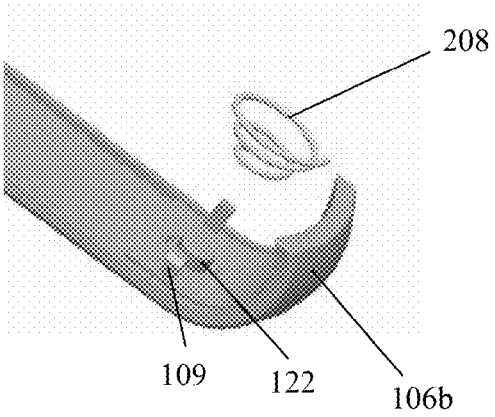
Figure 4H:
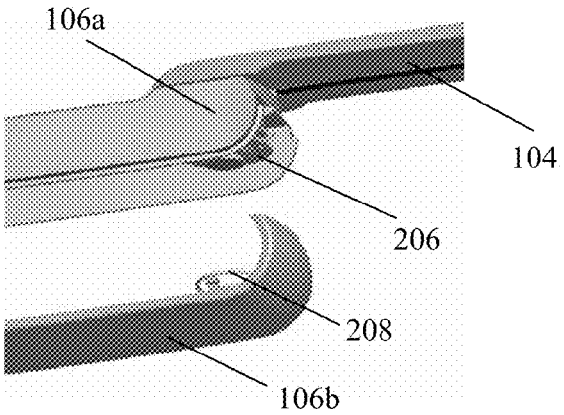

Arm 104 includes an annular pivot 112 which is inserted through an aperture 116 in the upper body 106*a* over the pivot coupling assembly 200, as shown in FIG. 4A. An end of arm 104 is coupled to an end 111 of the body 106 opposite to the speaker capsule 101 in one example.

Pivot coupling assembly 200 includes a first spring 202 biased against upper body 106*a*, a washer 204 operably coupled to first spring 202 and pivot 112, a lock 206 operably coupled to button rod 102 over pivot 112 and washer 204, and a second spring 208 biased against lock 206. First spring 202 is operably coupled to the exterior surface of an aperture wall 118 (providing aperture 116) with one end 202*a* biased against upper body 106*a* (see FIGS. 4C and 4C1). A center aperture 204*b* of washer 204 is positioned over pivot 112 of arm 104 and is locked in place rotationally relative to pivot 112, and a hook 204*a* of washer 204 is coupled to a second end of first spring 202 including a hook 202*b*. Washer 204 is fixedly connected to pivot 112 of arm 104 at least in terms of relative rotational position about a common center axis, and therefore first spring 202 provides torsion through washer 204 and pivot 112 to arm 104 to rotate to the open position when pivot coupling assembly 200 is actuated. Button rod 102 is positioned through aperture 114 and pivot 112 of arm 104, aperture 116 of upper body 106*a*, aperture wall 118, first spring 202, and washer 204. A button rod pin 102*a* is positioned through an aperture in lock 206 and fixedly connected to lock 206 via an adhesive means, such as hot melting. One end of second spring 208 is fixed in place to lower body 106*b* by tab 122 and the lower body 106*b* is operably coupled to upper body 106*a* by a coupling means, such as tabs 109. Other coupling means, such as an adhesive, are also possible. Second spring 208 provides bias against lock 206 to push a lock pin 206*a* into a slot 120 in upper body 106*a* in the closed position, as shown in FIGS. 2A, 2C, and 3B. In the closed position, as shown in FIGS. 2A and 2C, arm 104 is positioned to substantially fully overlap body 106.

Button rod 102 is operably coupled to pivot coupling assembly 200 and actuates the pivot coupling assembly when depressed to pivot the arm 104 open for accessing the microphone 110, as shown in FIG. 2B. Button rod 102, when depressed by the user, disengages the lock pin 206*a* from slot 120 (as shown by double sided arrow in FIG. 3B and assembly in FIG. 4D), and the bias from first spring 202 forces arm 104 to pivot open about pivot coupling assembly 200, in one example by about 180 degrees from the closed position.

In one embodiment, the arm of headset 100 may be actuated prior to or after insertion of the speaker capsule in a user's ear. Once actuated and the microphone accessed, the user may speak through the microphone with greater clarity. When desired, the user may then manually pivot the arm back to the first position to close the arm over the body.

Advantageously, the present invention provides headsets and methods for accessing a headset microphone that are efficient, automated, and stable on the ear.

The above-described embodiments of the present invention are merely meant to be illustrative and not limiting. It will thus be obvious to those skilled in the art that various changes and modifications may be made without departing from this invention in its broader aspects. Therefore, the appended claims encompass all such changes and modifications as falling within the true spirit and scope of this invention.

I claim:

1. A headset, comprising:

a body having an axis defined by a first surface and a second surface;

a pivot coupling housed by the body, wherein the pivot coupling includes a first spring, a washer, a lock, and a second spring;

a speaker capsule operably coupled to an end of the body opposite to the pivot coupling and at the second surface; and an arm operably coupled to the body, the arm capable of pivoting open and closed about the pivot coupling for accessing a microphone at a free end of the arm, wherein the arm pivots about the axis.

2. The headset of claim 1, wherein each of the speaker capsule and the microphone comprises a transducer and a faceplate.

3. The headset of claim 1, wherein the arm includes an annular pivot which is inserted through an aperture in the body over the pivot coupling.

4. The headset of claim 1, further comprising a button rod operably coupled to the pivot coupling, the button rod actuating the pivot coupling when depressed to pivot the arm open for accessing the microphone.

5. The headset of claim 4, wherein the button rod disengages the lock when depressed, the first spring provides a bias for the arm to pivot open, and the second spring provides a bias against the lock and the button rod.

6. The headset of claim 1, wherein the arm is coupled to an end of the body opposite to the speaker capsule.

7. The headset of claim 1, wherein the arm is capable of pivoting about 180 degrees about the pivot coupling.

8. A headset, comprising:

a body housing a pivot coupling including a first spring, a washer, a lock, and a second spring;

a speaker capsule operably coupled to the body;

an arm operably coupled to the body via the pivot coupling; and a button rod operably coupled to the pivot coupling, the button rod actuating the pivot coupling when depressed to pivot the arm open for accessing a microphone at a free end of the arm.

9. The headset of claim 8, wherein each of the speaker capsule and the microphone comprises a transducer and a faceplate.

10. The headset of claim 8, wherein the arm includes an annular pivot which is inserted through an aperture in the body over the pivot coupling.

11. The headset of claim 8, wherein the button rod disengages the lock when depressed, the first spring provides a bias for the arm to pivot open, and the second spring provides a bias against the lock and the button rod.

12. The headset of claim 8, wherein the speaker capsule is coupled to an end of the body opposite to the pivot coupling.

13. The headset of claim 8, wherein the arm is coupled to an end of the body opposite to the speaker capsule.

14. The headset of claim 8, wherein the arm is capable of pivoting about 180 degrees about the pivot coupling.

15. A method for accessing a headset microphone, the method comprising:

providing a headset including a body housing a pivot coupling, a speaker capsule operably coupled to the end of the body opposite to the pivot coupling, an arm operably coupled to the body via the pivot coupling, and a button rod operably coupled to the pivot coupling; and depressing the button rod to pivot the arm about the pivot coupling, thereby making accessible a microphone at a free end of the arm.

16. The method of claim 15, further comprising inserting the speaker capsule in a user's ear.

17. The method of claim 15, further comprising speaking through the accessed microphone.

18. The method of claim 15, further comprising manually pivoting the arm back to a first position to close the arm over the body.

* * * * *